US005462189A

United States Patent [19]

Pierce

[11] Patent Number: 5,462,189

[45] Date of Patent: Oct. 31, 1995

[54] RESEALABLE, REFILLABLE CONTAINER SYSTEM

[76] Inventor: Thomas W. Pierce, 3045 New Castle Dr., Marietta, Ga. 30064

[21] Appl. No.: 178,890

[22] Filed: Jan. 7, 1994

Related U.S. Application Data

[62] Division of Ser. No. 899,491, Jun. 16, 1992, Pat. No. 5,299,604.

[51] Int. Cl.[6] ..... B65D 51/18

[52] U.S. Cl. ..... 220/254; 220/331

[58] Field of Search ..... 220/254, 263, 220/331, 333, 335, 343, 344, 714, 715

[56] References Cited

U.S. PATENT DOCUMENTS

| | | | |
|---|---|---|---|
| 3,967,748 | 7/1976 | Albert . | |
| 4,057,167 | 11/1977 | Lee . | |
| 4,127,212 | 11/1978 | Waterbury | 220/254 |
| 4,170,724 | 10/1979 | Waterbury | 220/254 X |
| 4,232,797 | 11/1980 | Waterbury | 220/359 |
| 4,244,488 | 1/1981 | Fridl et al. | 220/260 |
| 4,361,250 | 11/1982 | Foster | 220/266 |
| 4,386,714 | 6/1983 | Roberto et al. | 220/339 |
| 4,407,423 | 10/1983 | Walter | 220/260 |
| 4,407,424 | 10/1983 | Heyn | 220/269 |
| 4,516,689 | 5/1985 | Barker | 220/335 |
| 4,819,829 | 4/1989 | Rosten et al. | 220/346 |
| 4,895,194 | 1/1990 | McCann et al. | 141/198 |
| 4,989,746 | 2/1991 | Pierce | 220/254 |

*Primary Examiner*—Steven M. Pollard

*Attorney, Agent, or Firm*—Louis T. Isaf; James A. Witherspoon

[57] ABSTRACT

A container system includes, in its most preferred embodiment, a dispenser and a resealable, refillable container having a container body and a closure apparatus which includes a plug movably connected to a platform section which is connected to the container body through a rim section. The platform section defines a recess having a recess floor and a recess wall and an ovoid plug aperture located within the recess floor which is partially shielded by an aperture floor and selectively occupied by an ovoid bottom portion of the plug. The aperture floor defines an air hole and an upper surface which contacts a bottom surface of a wide end of the bottom portion of the plug, corresponding to the end which first departs away from the plug aperture.

35 Claims, 7 Drawing Sheets

RESEALABLE, REFILLABLE CONTAINER SYSTEM

This application is a division of application Ser. No. 07/899,491, filed on Jun. 16, 1992, now U.S. Pat. No. 5,299,604.

BACKGROUND OF THE INVENTION

The present invention relates generally to field of dispensable product containers, and in its most preferred embodiments, to the field of resealable, refillable container systems.

Dispensable products, including beverages, other liquids, such as stains, paints, automotive and cleaning products, powders, such as laundry detergent, and solids such as capsules, tablets, marble-like objects or candies, etc. are currently available in a wide variety of dispensing containers, including cans, bottles, jugs, jars, boxes, bags, etc., constructed from a wide variety of materials, including glass, plastic, metal, paper, etc. Since many of these products are often consumed over various periods of time, many dispensing containers include resealable closure systems, including screw-top, bead & channel, and other structures such as those disclosed in U.S. Pat. Nos. 4,989,746, 4,232,797, 4,386,714, 4,516,689, and 4,819,829.

Certain products, such as carbonated beverages, are capable of producing relatively high levels of pressure inside containers. Consequently, choices for physical designs and construction materials for certain dispensing containers have been influenced, at least in part, to accommodate such high pressures in order to prevent leakage, accidental opening, or deformation of the containers. However, many such physical designs are complicated and/or difficult to open, resulting in broken fingernails or more serious injuries. Furthermore, one popular disposable closure design for soft drinks includes subjecting the stored liquid to a potentially dangerous breakaway tab, a design having obvious disadvantages.

Another consideration for dispensable containers relates to refillability. Due to an increasing awareness of our ever-growing landfills and desires to recycle and re-use resources, the benefits of refillable containers are clear. However, many closure systems are not very durable and tend to deteriorate in performance after prolonged periods of use. Furthermore, closure systems employing removable elements tend to promote loss or littering of the removable elements.

There is a need, therefore, to provide a resealable, refillable container system which addresses these and other related, and unrelated, problems.

SUMMARY OF THE INVENTION

Briefly described, the present invention, in its most preferred embodiment, comprises a system which includes a resealable, refillable container having a container body and a closure apparatus. The closure apparatus includes a detachable plug system movably connected to a platform section which is connected to the container body through a rim section. The platform section defines a recess having a recess floor and a recess wall and an ovoid plug aperture located within the recess floor which is partially shielded by an aperture floor and selectively occupied by an ovoid bottom portion of the plug. The aperture floor defines an air hole and an upper surface which contacts a bottom surface of the wide end of the plug, corresponding to the end which first departs away from the plug aperture.

In the preferred embodiment of the present invention, linkage arms, guide pins, and guide tracks defined in the platform section constrain the plug during opening and closing of the closure apparatus to move through a predefined path which cooperates with the ovoid plug aperture and bottom portion of the plug to, among other functions, eliminate friction caused by the trailing end and portions of the sides of the bottom portion of the plug and thus reduce wear on these parts. In addition, the location and shape of the aperture floor contribute to, among others, the strength, durability, reliability, and ease of operation of the closure apparatus of the preferred embodiment of the present invention. In addition, the recessing in the platform section reduces contact between the consumer and the closure apparatus to a minimum while allowing stacking of containers on top of one another.

The preferred embodiment of the present invention further includes a dispenser system for refilling the resealable, refillable container. The dispenser system includes a case, a storage area located within the case for storing dispensable material, and a nozzle for dispensing the dispensable material into the resealable, refillable container.

It is therefore an object of the present invention to provide a system which includes a dispenser system and a resealable, refillable container for dispensable material.

Another object of the present invention is to provide a closure system which is strong, durable, reliable, and easy to use.

Yet another object of the present invention is to provide a resealable, refillable container which includes a closure apparatus which includes a sheathing member which enhances the strength, reliability, and ease of use of the closure apparatus.

Still another object of the present invention is to provide a closure system which utilizes a method of guiding an ovoid plug in and out of an ovoid opening in a sliding motion, thus assuring proper seating of the plug.

Still another object of the present invention is to provide a closure system which is reusable on multiple containers, thus conserving resources used in packaging a product.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
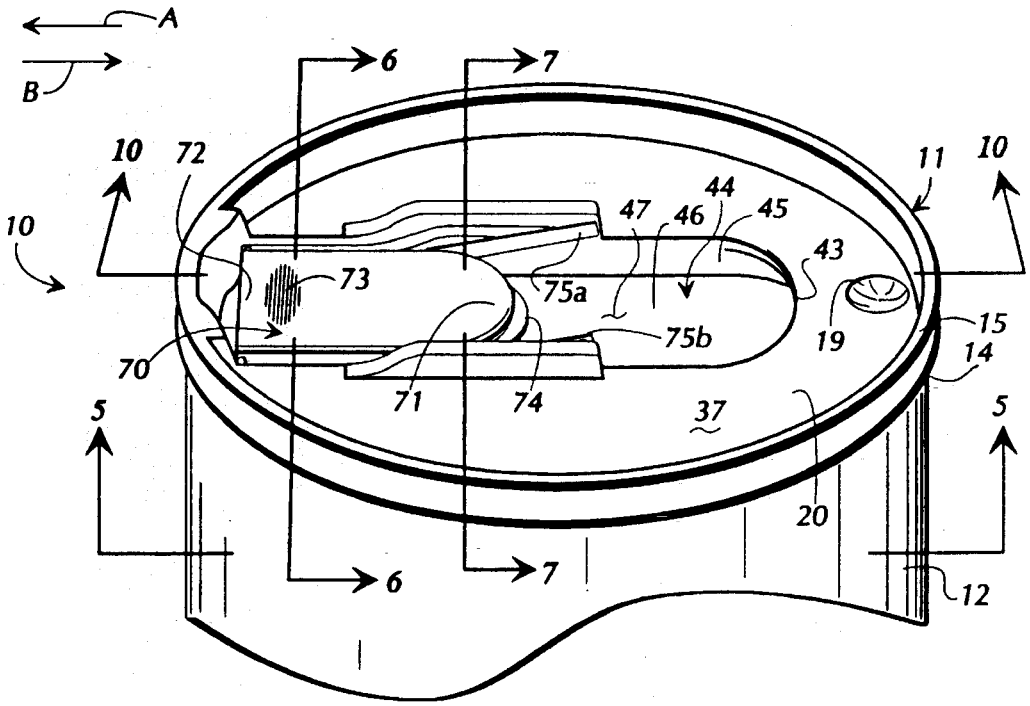
FIG. 1 is a cut-away perspective view of a container in accordance with the preferred embodiment of the present invention and shown in a closed condition.
Figure 2:
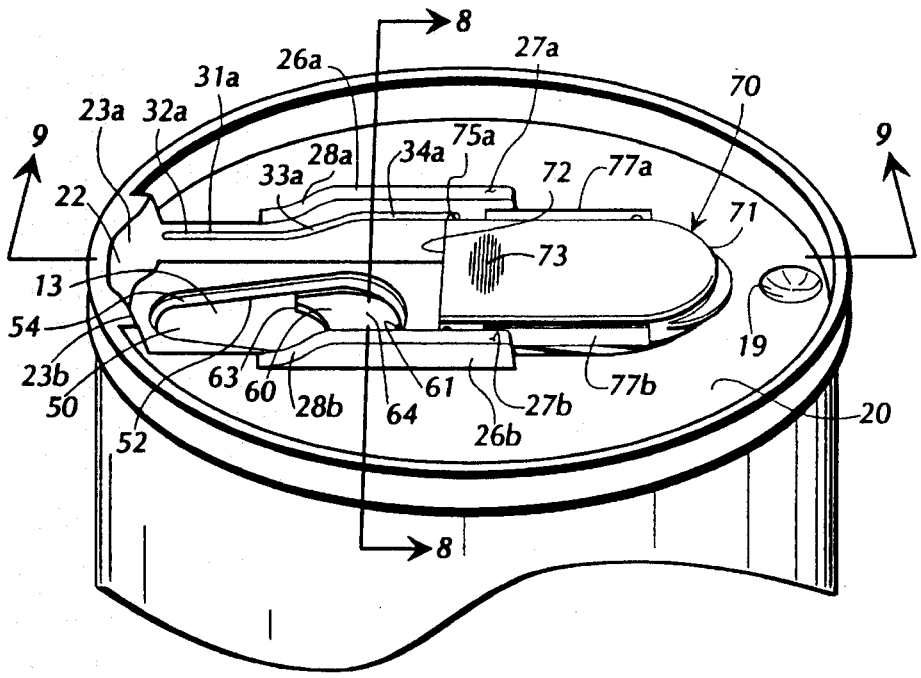
FIG. 2 is a cut-away perspective view of the container of FIG. 1, shown in an open condition.

Referring now in greater detail to the drawings, in which like numerals represent like components throughout the several views, a container 10, in accordance with the preferred embodiment of the present invention, is shown in FIGS. 1–14. With reference to FIGS. 1 and 2, which show cut-away perspective views of the container 10 in closed and open conditions, respectively, the container 10 includes a closure apparatus 11 connected to a container body 12. The container body 12 is shown defining a container interior 13 for the storage of dispensable products. The closure apparatus 11 is shown including a rim section 14 having a rim upper surface 15 which defines a rim upper surface plane. In the preferred embodiment of the present invention, a sealing adhesive maintains the connection between the rim section 14 and the container body 12, facilitating rapid removal for re-use when exposed to a selected solvent. In alternate embodiments, such connection is maintained through threads, pressure grips, etc.

The closure apparatus 11 further includes a platform section 20 extending inward from the rim section 14. The platform section 20 is shown defining a refiller crevice 19, discussed in detail below. The platform section 20 includes a platform upper surface 37 defining, in the preferred embodiment of the present invention, a platform upper surface plane which is parallel to, yet vertically displaced below, the rim upper surface plane defined by the rim upper surface 15. The platform section 20 also includes a recess wall 45 and recess floor 46 which define a plug recess 44. The recess floor 46 includes a recess floor upper surface 47 which defines a recess floor upper surface plane which, in the preferred embodiment of the present invention, is parallel to, yet vertically displaced below, the platform upper surface plane defined by the platform upper surface 37.

A plug catch 43 is shown formed into the recess wall 45 and extending into the plug recess 44 over the recess floor 46. On the opposite end of the plug recess 44, a trough 22 is shown extending up from the recess floor 46 to the rim upper surface 15 and including two trough shoulders 23*a,b*. The recess wall 45 is also shown defining two tracks 31*a,b* (track 31*b* being hidden from view) which extend upward into two guides 26*a,b*. Each track 31 includes a lower portion 32 which extends in a direction parallel to the recess floor upper surface plane, a ramp portion 33 which extends in a direction having a directional component perpendicular to the recess floor upper surface plane, and an upper portion 34 which extends in a direction parallel to the recess floor upper surface plane.

Each guide 26 is shown including a guide ramp 28 and a guide upper surface 27 which, in the preferred embodiment of the present invention, defines a plane which is parallel to, and co-planar with, the rim upper surface plane. Each guide 26 also includes a guide socket 29 (FIG. 3).

A ovoid, preferably teardrop-shaped, plug aperture 50 is defined in the recess floor 46 by an aperture wall 52 and extends into the container interior 13. An aperture floor 60 is shown extending below the plug aperture 50, partially sheathing the plug aperture 50. The aperture floor 60 includes an aperture floor upper surface 64 which defines an aperture floor upper surface plane which is parallel to, yet vertically displaced below, the recess floor upper surface plane. The aperture floor 60 further includes a curved aperture floor face 63 and defines an air hole 61 which extends into the container interior 13.

Figure 3:
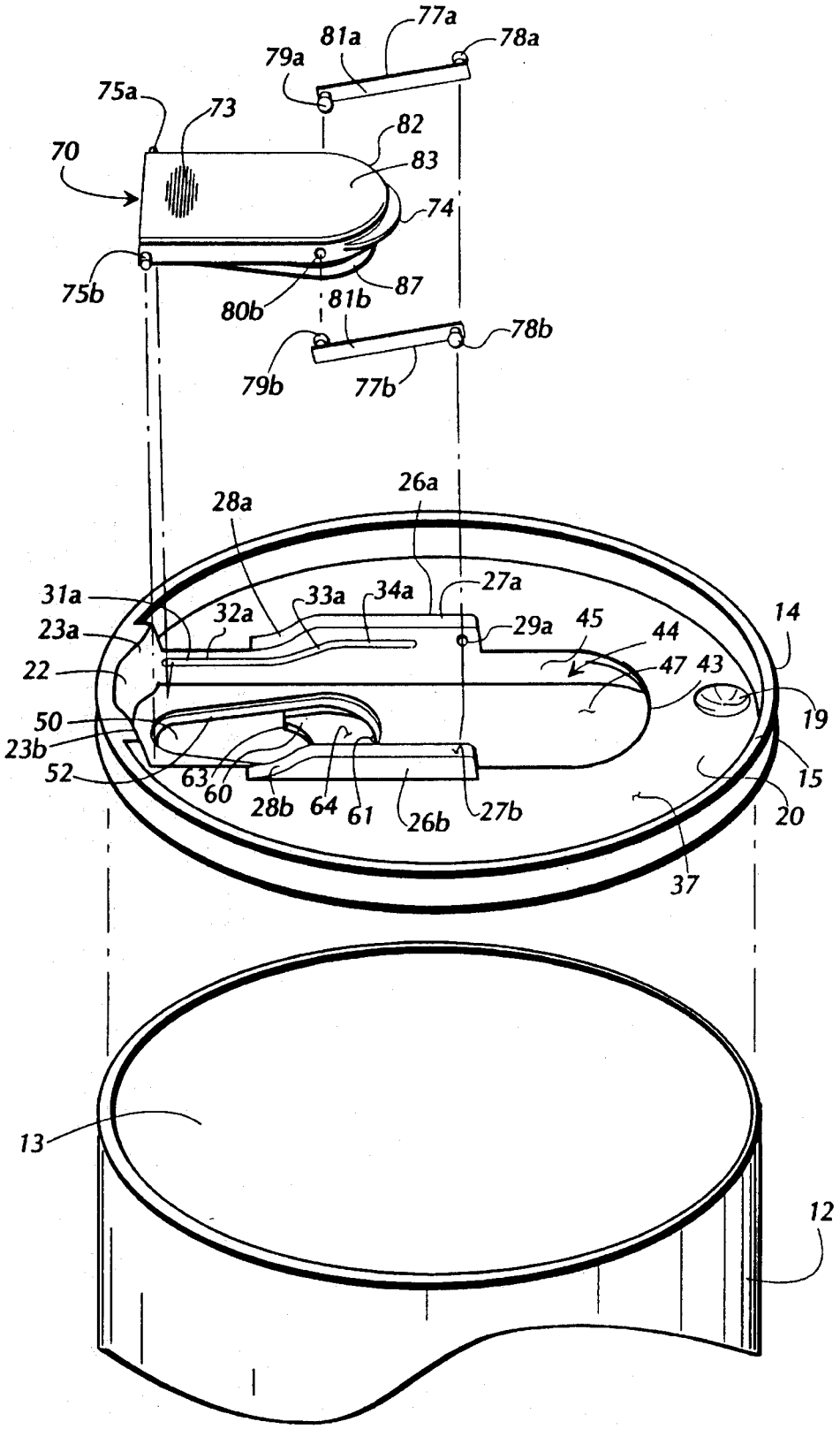
FIG. 3 is an exploded perspective view of the container of FIG. 1.

Referring now to FIG. 3, which shows an exploded perspective view of the container 10 of the preferred embodiment of the present invention, the closure apparatus 11 further includes a plug 70 which is movably connected to the platform section 20 through hinge arms 77*a,b*. Each hinge arm 77 includes a guide blade 81, a guide ball 78, and a plug ball 79. As assembled, the guide balls 78 occupy the guide sockets 29, and the plug balls 79 occupy two plug sockets 80 defined in opposing sides of a plug top 82. The plug top 82 further includes a finger lip 74 extending forward from a leading end 71 of the plug 70 and a thumb grip 73 located in a plug top upper surface 83 near a trailing end 72. Two guide pins 75*a,b* which ordinarily ride within the tracks 31 are shown extending outward from opposite sides of the plug top 82. The plug 70 further includes an ovoid, preferably teardrop-shaped, plug bottom 87 which is discussed in greater detail below.

Figure 4:
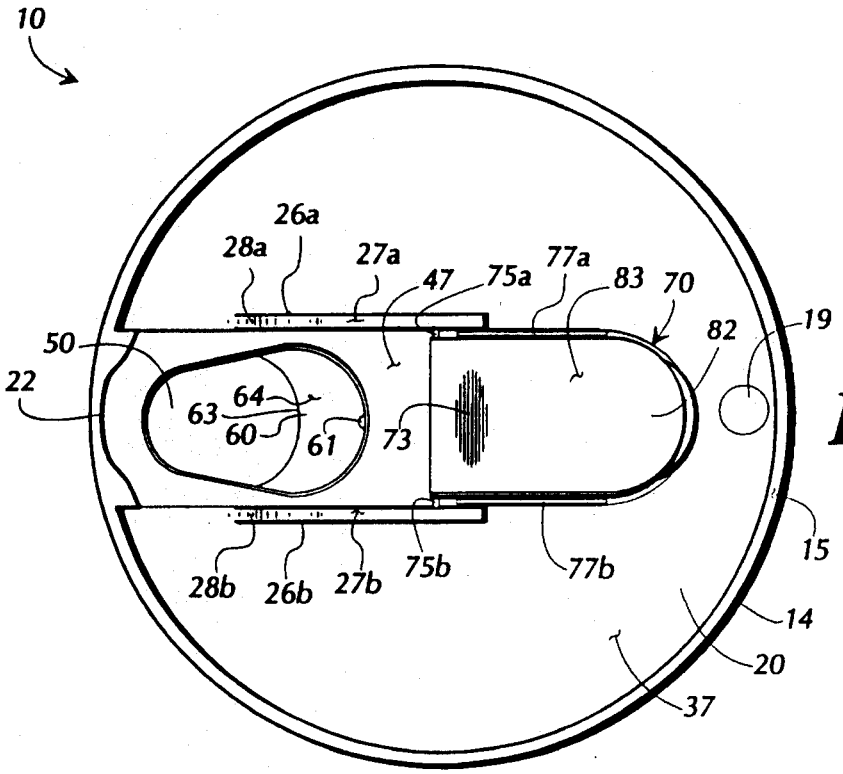
FIG. 4 is a top plan view of the container of FIG. 2.

FIG. 4, a top plan view of the container 10 of the preferred embodiment of the present invention in an open condition, more clearly shows the outline of the ovoid plug aperture 50 and aperture floor 60. The aperture floor 60 is shown extending under the wide end of the plug aperture 50 and including the air hole 61, the aperture floor upper surface 64, and the curved aperture face 63. The guide pins 75*a,b* are shown extending between opposing sides of the plug top 82 and the guides 26*a,b* as the plug rests on the recess floor upper surface 47.

Figure 5:
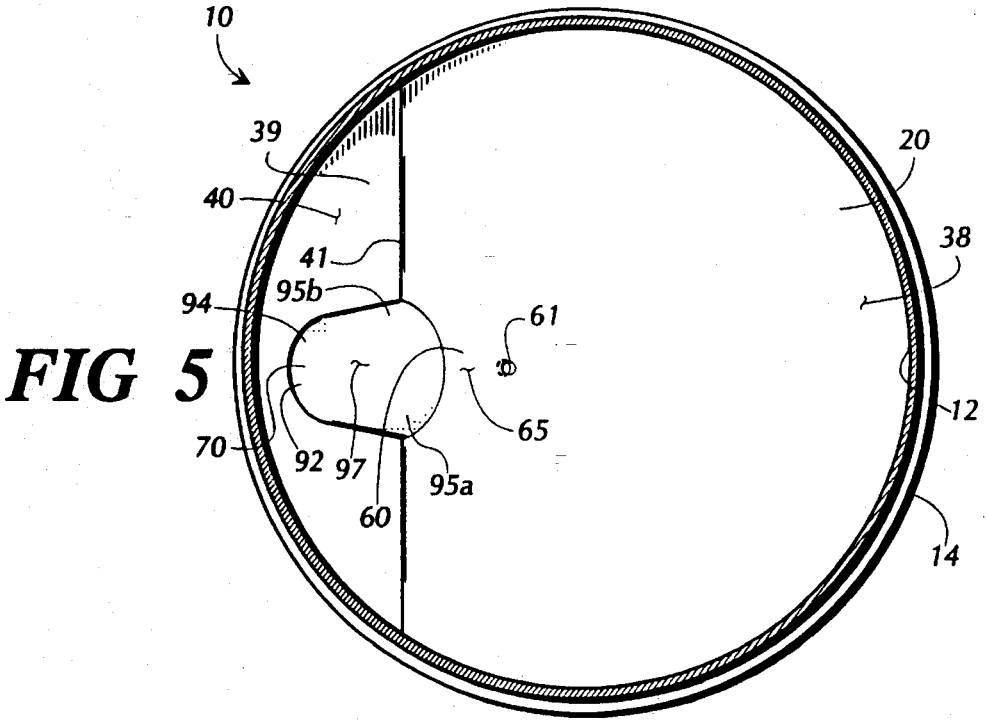
FIG. 5 is a bottom cross-sectional view of the container of FIG. 1, taken along line 5—5 of FIG. 1.

FIG. 5 shows a bottom cross-sectional view of the container 10 of the preferred embodiment of the present invention taken along line 5—5 of FIG. 1. The rim section 14 is shown connected to the container body 12, which is represented by cross-sectional hatching. The platform section 20 is shown including a platform lower surface 38 which defines a platform lower surface plane. The aperture floor 60 is shown including an aperture floor lower surface 65 which defines an aperture floor lower surface plane which is co-planar with the platform lower surface plane. The air hole 61 is shown extending through the aperture floor 60 at an angle, as shown by the dotted lines which represent the air hole 60 opening in the aperture floor upper surface 64 (FIG. 4). The platform section 20 further includes a cavity roof 40 and a cavity wall 41 which define an expansion cavity 39 as shown in FIG. 5. The plug 70 is shown including a plug belly 92 which includes a belly bottom surface 97.

Figure 6:
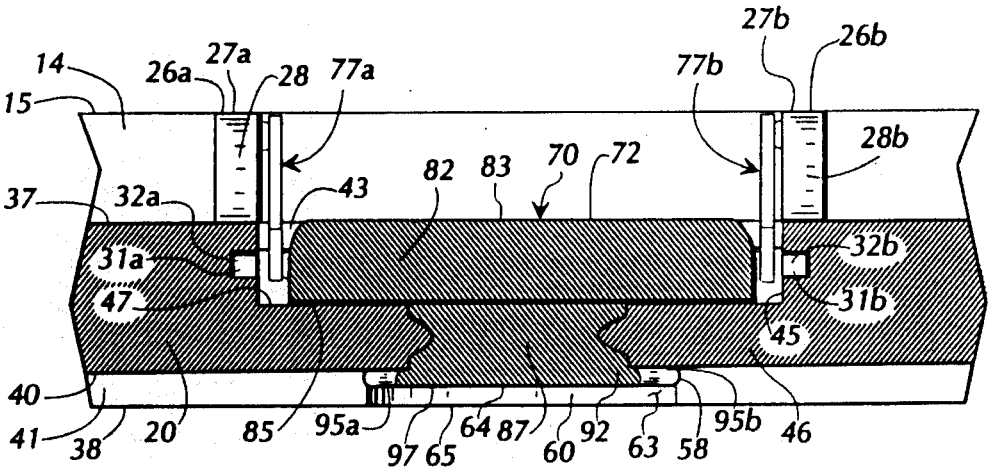
FIG. 6 is a cut-away, side cross-sectional view of the closure apparatus of FIG. 1, taken along line 6—6 of FIG. 1.

FIG. 6 shows a cut-away, side cross-sectional view of the closure apparatus 11, taken along line 6—6 of FIG. 1. The rim section 14 is shown including the rim upper surface 15. The platform section 20 is shown extending between the platform upper surface 37 and, in the background, the platform lower surface 38 and, in the foreground, the cavity roof 40, with the cavity wall 41 extending between the platform lower surface 38 and the cavity roof 40. The guides 26*a,b* are shown including the guide upper surfaces 27*a,b* and the guide ramps 28*a,b* and shown extending upward from the platform upper surface 37 to form extensions of the recess wall 45. The recess wall 45 is also seen defining the lower portions 32*a,b* of the tracks 31*a,b*.

The trailing end 72 of the plug 70 is shown including the plug top 82 which includes the plug top upper surface 83 and a plug top lower surface 85 which is resting on the recess floor 47. The plug top upper surface 83 is shown defining a plane which is co-planar with the platform upper surface plane defined by the platform upper surface 37. The plug 70 is also shown attached to the guides 26*a,b* through the hinge arms 77*a,b*. Since the cross-section line 6—6 of FIG. 1 cuts through the trailing end 72 of the plug 70, the plug bottom 87 of FIG. 6 is narrow. The belly bottom surface 97 of the plug bottom 87 is shown contacting the aperture floor upper surface 64 of the aperture floor 60. The plug belly 92 is also shown including belly sides 95*a,b* expanding out under the cavity roof 40 and into an expansion flare 58 defined by the recess floor 46 along the periphery of the aperture floor 60. The curved aperture floor face 63 is also shown extending below the plug bottom 87 to the aperture floor lower surface 65.

Figure 7:
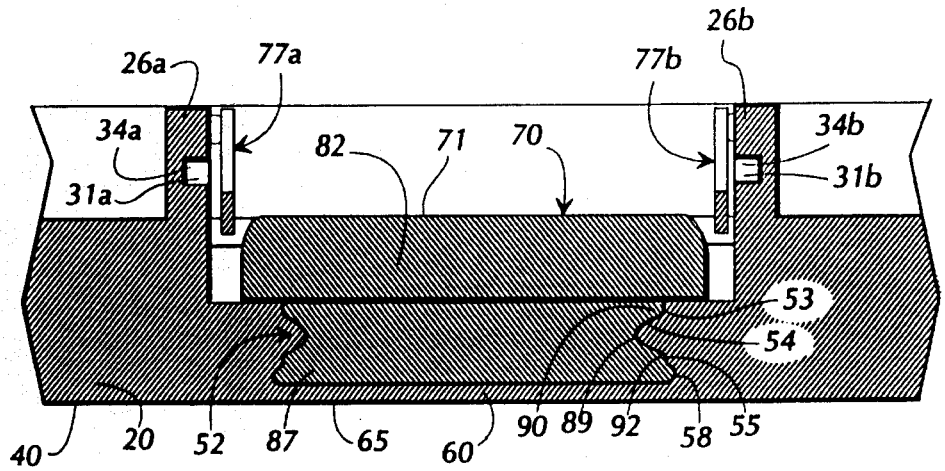
FIG. 7 is a cut-away, side cross-sectional view of the closure apparatus of FIG. 1, taken along line 7—7 of FIG. 1.

FIG. 7 is very similar to FIG. 6 and shows a cut-away, side cross-sectional view of the closure apparatus 11, taken along line 7—7 of FIG. 1. The upper portions 34*a,b* of the tracks 31*a,b* are shown defined in the guides 26*a,b*, which are represented in cross-section, and the hinge arms 77*a,b* are shown in cross section. Since the cross-section line 7—7 of FIG. 1 cuts through the leading end 71 of the plug 70, the plug bottom 87 of FIG. 7 is wide. The plug bottom 87 is shown including a plug upper shoulder 90 which is separated from the plug belly 92 by a plug channel 89 which encircles the plug bottom 87. The plug bottom 87 is shown seated against the aperture wall 52, which is shown including an aperture top shoulder 53, aperture bead 54, and aperture bottom shoulder 55. The plug belly 92 is also seen expanding into the expansion flare 58, which is seen extending between the aperture bottom shoulder 55 and the aperture floor 60.

Figure 8:
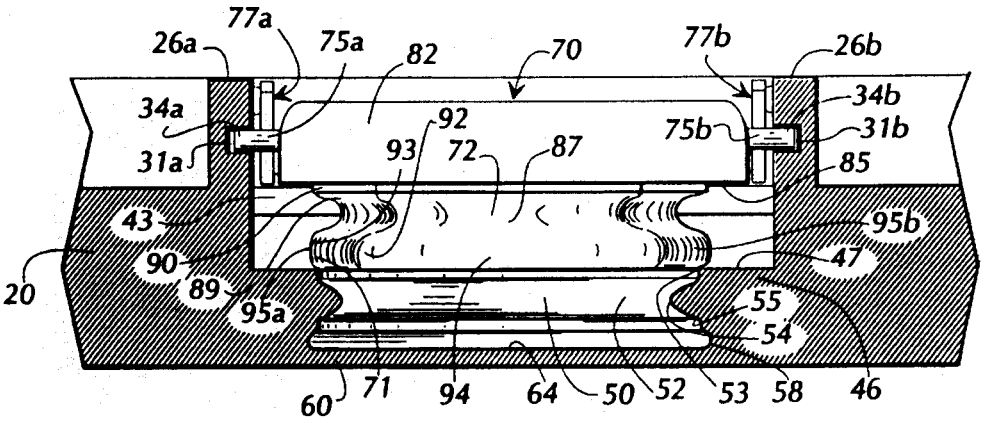
FIG. 8 is a cut-away, side cross-sectional view of the closure apparatus of FIG. 2, taken along line 8—8 of FIG. 2.

FIG. 8 shows a cut-away, side cross-sectional view of the closure apparatus 11, taken along line 8—8 of FIG. 2, which shows an open condition. FIG. 8 is identical to FIG. 7, with the exception of the plug 70 being shown removed from the plug aperture 50 and resting on the recess floor 46 so that the belly bottom surface 97 is in contact with the recess floor upper surface 47. The guide pins 75*a,b* are shown resting in the tracks 31*a,b* and connecting the trailing end 72 of the plug 70 to the guides 26*a,b*.

Figure 9:
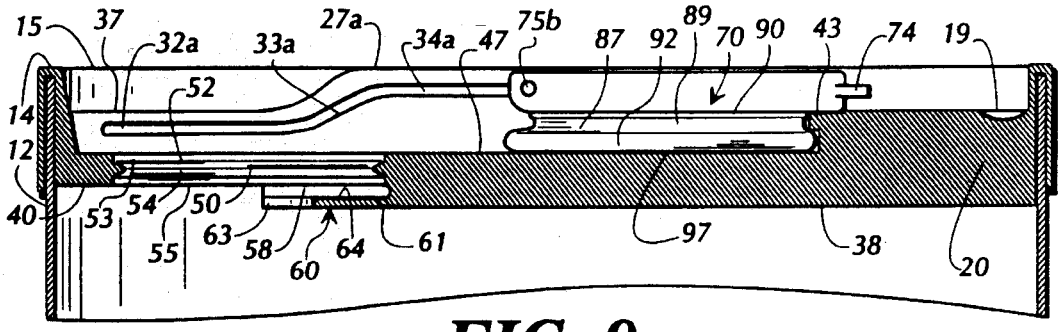
FIG. 9 is a cut-away, front cross-sectional view of the container of FIG. 2, taken along line 9—9 of FIG. 2.
Figure 10:
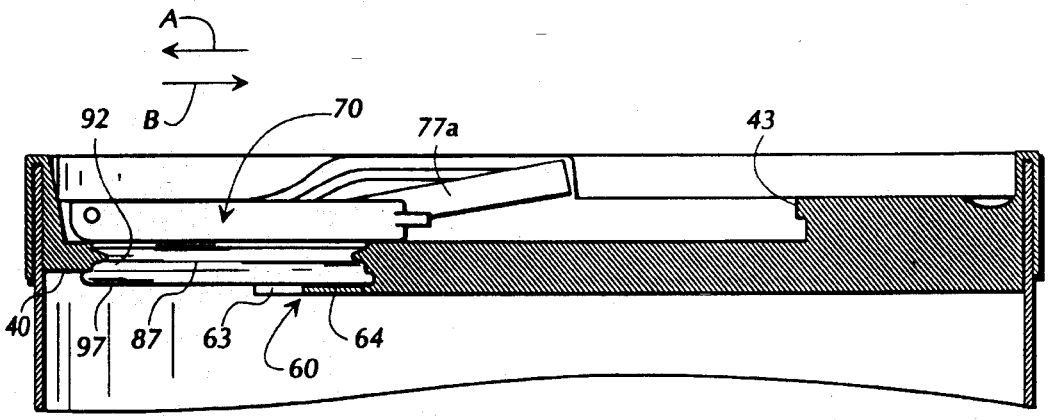
FIG. 10 is a cut-away, front cross-sectional view of the container of FIG. 1, taken along line 10—10 of FIG. 1.
Figure 11:
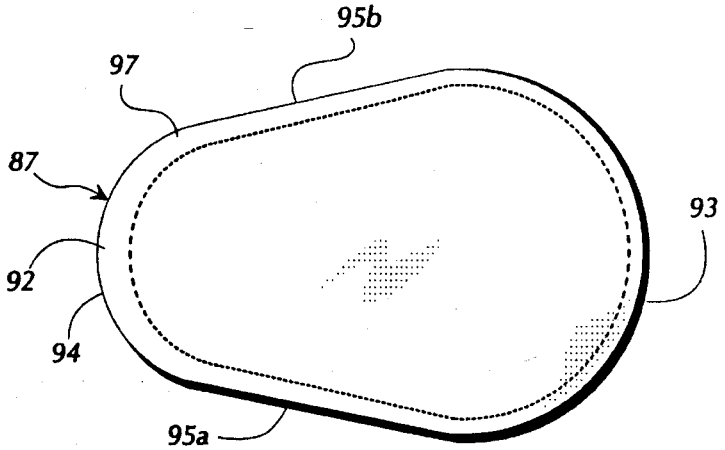
FIG. 11 is a bottom view of the bottom portion of the plug of FIG. 1, shown with the plug channel represented by dotted lines.

FIGS. 9 and 10 show cut-away, front cross-sectional views of the container 10 in the open conditions taken along line 9—9 of FIG. 2, and the closed condition taken along line 10—10 of FIG. 1. As can be seen more clearly in FIG. 11, the plug belly 92 of the plug bottom 87 is shown extending farther out from the plug channel 89 (the innermost points of which are represented in dotted lines in FIG. 11) on the belly trailing end 94 than on the belly leading end 93, corresponding to the plug trailing end 71 and leading end 72, respectively. FIG. 11 also reveals the gradual tapering of this distinction along the belly sides 95*a,b*.

Figure 12:
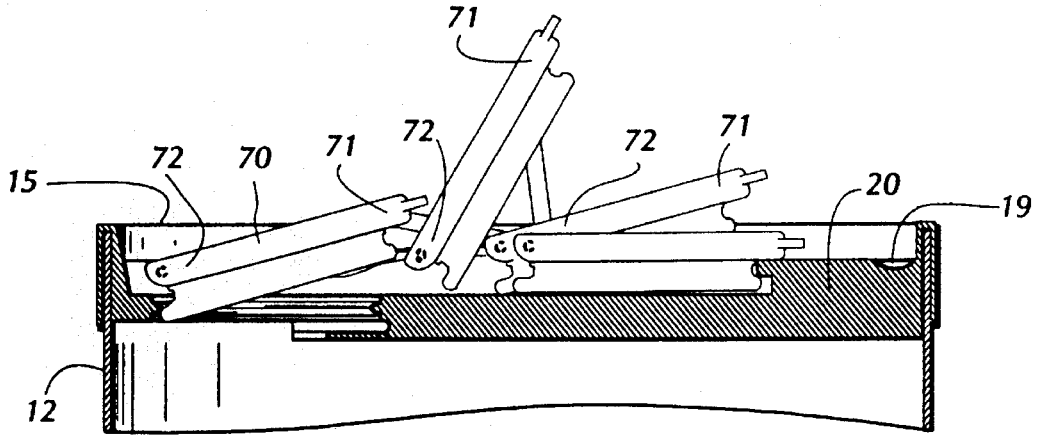
FIG. 12 is a cut-away, front cross-sectional view, similar to FIGS. 9 and 10, of the container of FIG. 1, showing several positions of the plug.

Referring again to FIGS. 9 and 10, the aperture floor 60 is shown with the curved aperture floor face 63 and the inclined air hole 61. In FIG. 9, the plug 50 is shown secured in place by the plug catch 43 which extends slightly into the plug channel 89 to engage the plug belly 92. The refiller crevice 19 is also shown extending into the platform section 20. In FIG. 10, the plug bottom 87 is seated in the plug aperture 50 (FIG. 9) through interaction with the plug wall 52 (FIG. 9). Due to the different plug belly widths discussed above with reference to FIG. 11, the plug belly 92 is seen extending further under the cavity roof 40 than into the expansion flare 58. FIG. 12 shows a cut-away, front cross-sectional view, similar to FIGS. 9 and 10, showing several positions of the plug 70, as is discussed in greater detail below.

Figure 13:
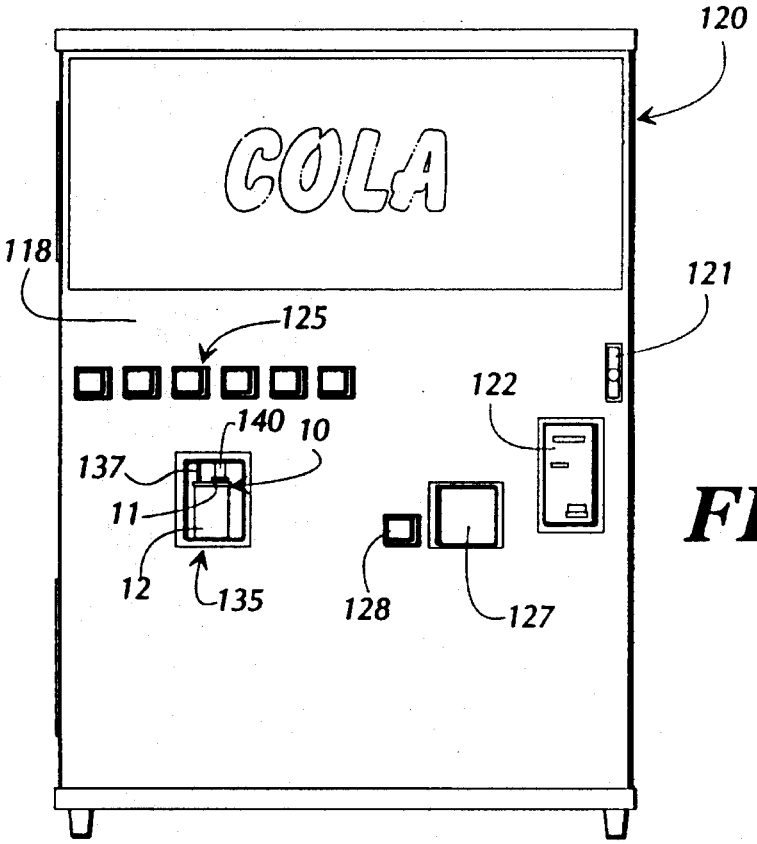
FIG. 13 is a front view of a dispenser system in accordance with the preferred embodiment of the present invention.

FIG. 13 show a front view of a vending dispenser system 120 in accordance with the preferred embodiment of the present invention. A dispenser case 118 is shown including a lock 121, a money assembly 122, a container delivery portal 127, and a container control 128. A set of selection controls 125 is located above a dispensing portal 135 in which are located a delivery nozzle 140 and a positioning rod 137, both of which are engaging a container 10 of the preferred embodiment of the present invention.

Figure 14:
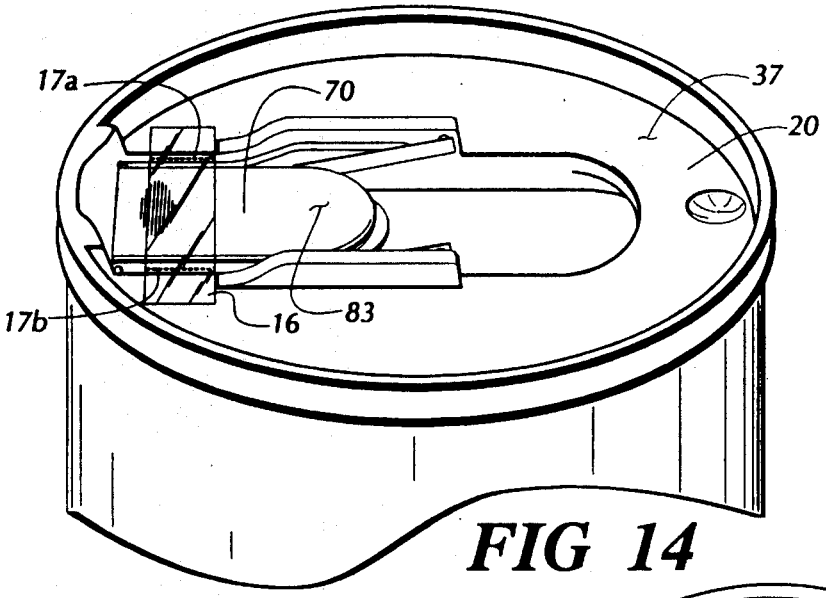
FIG. 14 is a cut-away perspective view of the container of FIG. 1, shown with tamper-evident tape.

FIG. 14 shows a cut-away perspective view of the container 10 of the preferred embodiment of the present invention with tamper-evident tape 16 applied across the plug 70. Tape perforations 17*a,b* are shown formed in the tamper-evident tape 16 on each side of the plug 70. The tamper-evident tape 16 provides a consumer with an indication of prior opening, thus enhancing safety and consumer confidence in product integrity.

OPERATION

Discussion of the operation of the container 10 of the preferred embodiment of the present invention, referenced in FIGS. 1–14, begins when a consumer receives a product-filled container 10 with a sealed closure apparatus 11, as shown in FIGS. 1, 5–7, and 10. Among other results, use of the aperture floor 60 decreases both the amounts of area and perimeter distance of the plug bottom 87 which are exposed to the container interior 13. These reductions contribute to, among others, a reduction in the effective force which acts upon the plug bottom 87 due to pressure from within the container 10, as well as reliability of the seal against unintentional opening and leakage. Furthermore, use of the aperture floor 60 shifts, in the direction of arrow "A" (FIGS. 1 and 10), the center of the effective force applied by pressurized products. Such a shift provides a further mechanical advantage which benefits ease of use without sacrificing seal strength and durability.

To move the plug 70 from the closed condition shown in FIG. 1 to the open condition shown in FIG. 2, a consumer first inserts a finger under the finger lip 74; the thumb may rest on grip 73 to provide added stability. The guides 26*a,b* and plug recess 44 aid in blocking inadvertent access to the finger lip 74. Furthermore, since the guide upper surfaces 27*a,b* are co-planar with the rim upper surface 15, the guides 26*a,b* can provide additional support to objects, such as additional containers 10, stacked on top of the container 10.

As the consumer applies a lifting force under the finger lip 74, the hinge arms 77*a,b* constrain the leading end 71 of the plug 70 to move in an arcuate path which causes the trailing end 72 to initially move very slightly in the direction of arrow "A" and then in the direction of arrow "B". This applied force may be supplemented by thumb pressure applied at thumb grip 73. After reaching the apex of the arcuate path, a subsequent downward force on the leading end 71 engages this leading end 71 into the plug catch 43, as the trailing end 72 continues in direction "B". This open condition is shown in FIG. 2. The path of the trailing end 72 of the plug 70 is constrained by guide pins 75*a,b* in a path defined by the tracks 31*a,b*.

Analyzing the opening process in more detail, as the leading end 71 of the plug 70 begins moving along the arcuate path defined by the hinge arms 77*a,b*, the locations and orientations of the hinge arms 77*a,b* constrain the leading end 71 of the plug 70 to move slightly in a direction having a directional component in the direction of arrow "A". Furthermore, the trailing end 72 of the plug 70 is essentially moved solely in the direction of arrow "A". In the preferred embodiment of the present invention, the plug top 82, is constructed of a fairly rigid material, such as a hard plastic, whereas the plug bottom 87 is constructed of a more deformable material such as neoprene. During this first motion of the plug 70, the trailing end 72 of the plug bottom 87 compresses slightly, and the leading end 71 of the plug bottom 87 expands away from the aperture wall 52, lessening wear on the leading end 71 of the plug bottom 87. This first motion of the plug 70 continues until the hinge arms 77*a,b* extend in directions parallel to the plug top upper surface 83.

As the leading end 71 of the plug 70 continues in the arcuate path defined by the hinge arms 77*a,b*, the plug 70 begins to "slide" out of the plug aperture 50. In other words, the trailing end 72 of the plug 70 begins moving in the direction of arrow "B" so that the narrow belly trailing end 94 (FIGS. 5, 11) and at least portions of the belly sides 95*a,b* move laterally away from the aperture wall 52 without being forced to deform when passing by the aperture bead 54. This cooperation between the hinge arms 77*a,b*, guide pins 75*a,b*, tracks 31*a,b*, and ovoid shapes of the plug bottom 87 and the plug aperture 50 aids in preserving a large portion of the plug bottom 87, thus increasing durability of the closure apparatus 11. Furthermore, the larger belly trailing end 94 and trailing end portions of the belly sides 95*a,b* (as discussed above) take advantage of this sliding motion to improve seal strength and reduce the possibility of leakage.

Before the trailing end 72 of the plug bottom 87 reaches the aperture floor face 63 of the aperture floor 60, the guide pins 75*a,b* reach the ramp portions 32*a,b* of the tracks 31*a,b*. As the guide pins 75*a,b* move up the ramp portions 32*a,b*, the trailing end 72 of the plug 70 has a directional component perpendicular to the recess floor upper surface 47 so that the trailing end 72 of the plug 70 clears the aperture floor 60 and the recess floor 46. As the guide pins 75*a,b* reach the upper portions 34*a,b* of the tracks 31*a,b*, the plug 70 is again constrained to move in the direction of arrow "B" until reaching the open condition shown in FIG. 2.

In the open condition, the customer may dispense the enclosed product through the plug aperture 50. The air hole 61 provides a separate entryway for air into the container interior, aiding the flow of liquid products through the plug aperture 50. The trough 22 assists in directing the product away from the container 10 in a uniform, more manageable stream. A consumer may re-close the closure apparatus 11 through lifting the leading end 71 of the plug 70 away from engagement with the plug catch 43 and reversing the motion discussed above. The sliding action is reversed and acts to seat the plug bottom 87 as it enters the plug aperture 50.

One method of obtaining and refilling the container 10 of the present invention is through operating the vending dispenser system 120. A consumer inserts money into the money assembly 122 and operates the container control 128 and/or selection controls 125. In the preferred embodiment of the present invention, manipulation of the container control 128 causes the vending dispenser system 120 to transfer an empty container 10 to the container delivery portal 127. In other embodiments, pre-filled containers 10 are provided.

To refill a container 10, a consumer places an empty, open container 10 into the dispensing portal 135. To ensure proper delivery of product into the container 10, the consumer aligns the positioning rod 137 with the refiller crevice 19 formed in the platform section 20 of the closure apparatus 11 (FIG. 1) of the preferred embodiment of the present invention. Other alignment systems, including automatic alignment systems utilizing rotating platforms, magnetic sensing alignment devices, or holographic systems are also included within the scope of the present invention.

After the container 10 is aligned within the dispensing portal 135, the consumer chooses a desirable product type and manipulates the selection controls 125. The vending dispenser system 120 then transfers into the container 10 through the delivery nozzle 140 a predefined amount of the selected product from a product storage area (not shown) inside the dispenser case 118. The lock 121 prevents unauthorized entry into the dispenser case 118.

Figure 15:
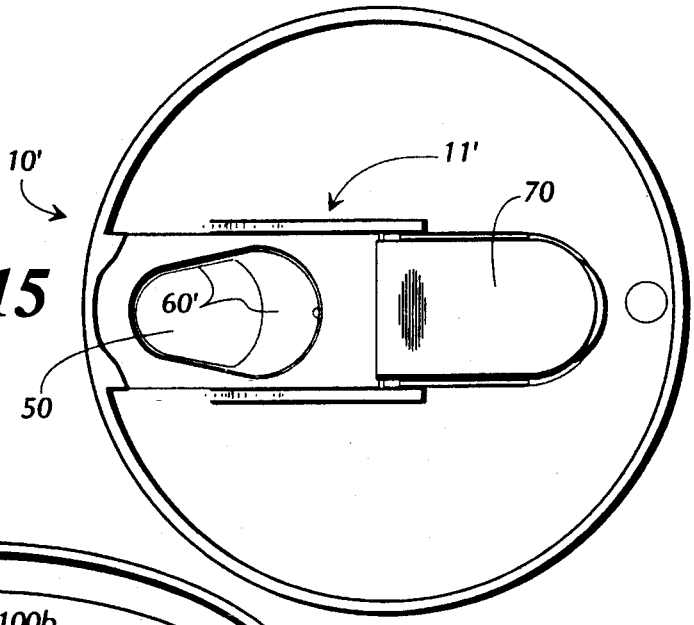
FIG. 15 is a top plan view of a container in accordance with an alternate embodiment of the present invention.

FIG. 15 is a top plan view of a container 10' in accordance with an alternate embodiment of the present invention. An aperture floor 60' is shown extending around the entire periphery of the plug aperture 50. As with the aperture floor 60 (FIG. 8) of the preferred embodiment of the present invention, an expansion flare 58 (FIG. 8) extends between the aperture bottom shoulder 55 (FIG. 8) and the aperture floor 60'. Operation of the closure apparatus 11' of the alternate embodiment shown in FIG. 15 is very similar to that of the preferred embodiment of the present invention. The additional aperture floor 60' portions provide additional leakage and seal strength advantages.

Figure 16:
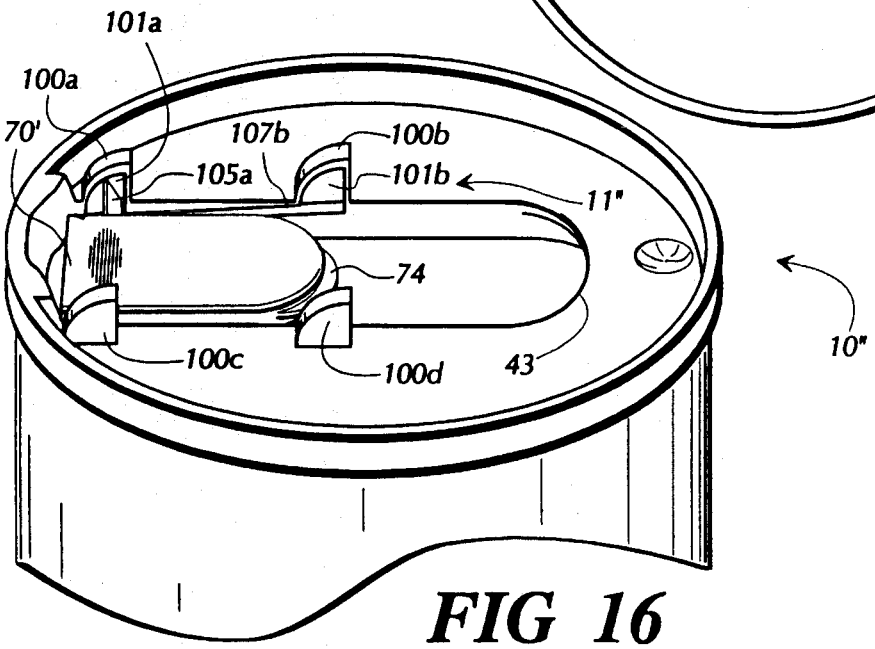
FIG. 16 is a cut-away perspective view of a container in accordance with another alternate embodiment of the present invention.

FIG. 16 is a cut-away perspective view of a container 10" in accordance with another alternate embodiment of the present invention. Socket heads 100*a–d* having sockets 101*a–d*, wing tracks 107*a,b*, and guide wings 105*a,b* replace the guides 26*a,b*, tracks 31*a,b*, and guide pins 75*a,b*, respectively, of the preferred embodiment of the present invention. Additionally, the hinge arms 77*a,b* of the preferred embodiment of the present invention are not included in the container 10" of FIG. 16.

To operate the closure apparatus 11" of the alternate embodiment shown in FIG. 16, a consumer lifts the finger lip 74 of the plug 70', rotating the guide wings 105*a,b* within the sockets 101*a,c*. When the guide wings 105*a,b* are aligned with the wing tracks 107*a,b*, the consumer pushes the plug 70' up the wing tracks 107*a,b* until the guide wings 105*a,b* reach the socket heads 100*b,d*. The consumer is then able to push the plug 70' downward, rotating the guide wings 105*a,b* within the sockets 101*b,d* of the socket heads 100*b,d*, to engage the plug catch 43.

Although the closure apparatus 11 of the preferred embodiment of the present invention, with the exception of the plug bottom 87 discussed above, is constructed of a somewhat rigid material, such as a hard plastic, the scope of the present invention is intended to include alternate embodiments constructed, in whole or in part, of other acceptable construction materials, including aluminum, other metals, glass, and various paper products. Furthermore, although the preferred embodiment of the present invention is disclosed with reference to the closure apparatus 11 being mounted on top of a can for storing liquids, the scope of the present invention includes alternate embodiments wherein, without limitation, the closure apparatus 11 is mounted in alternate locations, including sides and bottoms, of alternate containers, including bottles, jugs, jars, boxes, and bags, for storing alternate products, such as foods, candies, other liquids, powders, and dispensable solids.

Other embodiments of the present invention include reversing the orientation of the plug aperture 50 and plug bottom 87 and reversing the type of materials used in the plug channel 89 and the aperture bend 54. Furthermore, variations of various dimensions of the preferred embodiment of the present invention, including the size and shape of the plug belly 92, the length of the hinge arms 77*a,b,* and the height of the guides 26*a,b,* are understood to be within the scope of the present invention.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that the relative dimensions and relationships shown on the drawings are given as the preferred relative dimensions and relationships, but the scope of the invention is not to be limited thereby.

I claim:

1. A resealable closure apparatus for sealing a container, said apparatus comprising:

a platform section connected to a container, said platform section defining a plug aperture, and including a recessed floor located adjacent said plug aperture;

a plug so movably connected to said platform section that said plug selectively occupies said plug aperture;

a rim section interposed between the container and said platform section, wherein said rim section includes a rim upper surface defining a rim upper plane; and wherein said platform section further includes a platform upper surface, and a support section extending above said platform upper surface, and including a support upper surface located in said rim upper plane.

2. Apparatus of claim 1, wherein said support section includes means for guiding said plug relative to said platform section.

3. Apparatus of claim 1, wherein said platform section further includes, a plug aperture wall defining said plug aperture, wherein said aperture wall defines an inner most vertical aperture wall plane, and a plug aperture floor extending from said aperture wall, beyond said vertical aperture wall plane, and beneath a portion of said plug aperture.

4. Apparatus of claim 3, wherein said plug aperture floor defines an air opening.

5. Apparatus of claim 3, wherein said plug aperture wall further defines an aperture first end and an aperture second end, wherein said aperture first end is more proximate to the geometrical center of said platform section than said aperture second end, wherein said aperture floor extends from said aperture wall proximate said aperture first end and beneath a portion of said plug aperture.

6. Apparatus of claim 5, wherein said plug aperture floor defines an air opening proximate to said aperture first end.

7. Apparatus of claim 3, wherein said plug includes a belly with a belly bottom surface, wherein said plug aperture floor includes a top surface wherein said top surface contacts a portion of said belly bottom surface when said plug occupies said plug aperture.

8. Apparatus of claim 7, wherein said plug belly includes a first end and an opposing second end, and wherein said top surf:ace of said aperture floor contacts said first end of said belly bottom surface when said plug occupies said plug aperture.

9. A resealable closure apparatus for sealing a container, said apparatus comprising:

a platform section connected to a container, said platform section defining a plug aperture, a first track, and a second track, wherein said platform section includes, an upper surface, a recessed floor located adjacent the plug aperture, a first recess wall located adjacent said recessed floor and below said upper surface and defining a first section of said first track, a first guiding head located partially above said upper surface and defining a second section of said first track, a second recess wall located adjacent said recessed floor and below said upper surface and defining a first section of said second track, and a second guiding head located partially above said upper surface and defining a second section of said second track; and a plug so movably connected to said platform section that said plug selectively occupies said plug aperture, wherein said plug includes a leading end, a trailing end, a first side and an opposing second side, and a first pin member extending from a first side of said trailing end and guiding in said first track and a second pin member extending from said second side of said trailing end and guiding in said second track.

10. The apparatus of the above claim 9, wherein said platform section further includes a first hinge arm with a button end pivotally connected to said leading end first side, and a guide head end pivotally connected to said first guiding head, and a second hinge arm with a button end pivotally connected to said leading end second side, and a guide head end pivotally connected to said second guiding head.

11. Apparatus of claim 9, wherein said platform section further includes, a plug aperture wall defining said plug aperture, wherein said aperture wall defines an inner most vertical aperture wall plane, and a plug aperture floor including an upper surface, wherein said plug aperture floor extends from said aperture wall, beyond said vertical aperture wall plane, and beneath a portion of said plug aperture.

12. Apparatus of claim 11, wherein said plug aperture floor defines an air opening.

13. Apparatus of claim 11, wherein said plug aperture wall further defines an aperture first end and an aperture second end, wherein said aperture first end is more proximate to the geometrical center of said platform section than said aperture second end, and wherein said aperture floor extends from said aperture wall proximate said aperture first end and beneath a portion of said plug aperture.

14. Apparatus of claim 13, wherein said plug aperture floor defines an air opening proximate to said aperture first end.

15. Apparatus of claim 11, wherein said plug includes a belly with a belly bottom surface, and wherein said plug aperture floor includes a top surface wherein said top surface contacts a portion of said belly bottom surface when said plug occupies said plug aperture.

16. Apparatus of claim 11, wherein said plug includes a plug belly and said plug belly includes a leading end adjacent said leading end of said plug and a trailing end adjacent said trailing end of said plug, and wherein said upper surface of said aperture floor contacts said leading end of said plug belly when said plug occupies said plug aperture.

17. A resealable closure apparatus for sealing a container, said apparatus comprising:

a platform section connected to a container and including a plug aperture wall defining a plug aperture and an inner most vertical aperture wall plane; and a plug so movably connected to said platform section that said plug selectively occupies said plug aperture, wherein said platform section further includes a plug aperture floor with a top surface, and wherein said plug aperture floor extends from a section of said aperture wall, beyond said inner most vertical aperture wall plane, and beneath a section of said plug aperture.

18. Apparatus of claim 17, wherein said plug aperture floor defines an air opening.

19. Apparatus of claim 17, wherein said plug aperture wall further defines an aperture first end and an aperture second end, wherein said aperture first end is more proximate to the geometrical center of said platform section than said aperture second end, and wherein said plug aperture floor extends from said aperture wall proximate said aperture first end and beneath a portion of said plug aperture.

20. Apparatus of claim 19, wherein said plug aperture floor defines an air opening proximate to said aperture first end.

21. Apparatus of claim 17, wherein said plug includes a belly with a belly bottom surface, wherein said top surface of said plug aperture floor contacts a portion of said belly bottom surface when said plug occupies said plug aperture.

22. Apparatus of claim 17, wherein said plug includes a plug belly and said plug belly includes a first end and an opposing second end, and wherein said top surface of said aperture floor contacts said first end of said belly bottom surface when said plug occupies said plug aperture.

23. Apparatus of claim 17, said platform section further including a recessed floor adjacent said plug aperture.

24. A resealable closure apparatus for sealing a container, said apparatus comprising:

a platform section connected to a container and including a plug aperture wall defining a plug aperture and an inner most vertical aperture wall plane, wherein said platform section further includes a plug aperture floor with a top surface, and wherein said aperture floor extends from a section of said plug aperture wall, beyond said inner most vertical aperture wall plane, and beneath a section of said plug aperture.

25. Apparatus of claim 24, wherein said apparatus further comprises a plug so movably connected to said platform section that said plug selectively occupies said plug aperture, said plug including, a lower most bottom surface, a fulcrum end, and an opposing leading end, and wherein said top surface of said aperture floor contacts said lower most bottom surface of said plug proximate to said leading end when said plug occupies said plug aperture.

26. Apparatus of claim 24, wherein said apparatus further comprises a rim section interposed between said container and said platform section, wherein said rim section includes a rim upper surface defining a rim upper plane, and wherein said platform section further includes a recessed floor located adjacent said plug aperture, a platform upper surface, and a support section extending above said platform upper surface and including a support upper surface located in said rim upper plane.

27. Apparatus of claim 24, wherein said plug aperture floor defines an air opening.

28. A resealable closure apparatus for sealing a container, said apparatus comprising:

a platform section connected to a container and including a plug aperture wall defining a plug aperture, and a plug aperture floor with a top surface; and a plug so movably connected to said platform section that said plug selectively occupies said plug aperture, said plug including a lower most bottom surface, wherein said aperture floor extends from a section of said plug aperture wall and beneath a section of said lower most bottom surface of said plug when said plug occupies said plug aperture.

29. Apparatus of claim 28, wherein said apparatus further comprises a rim section interposed between said container and said platform section, wherein said rim section includes a rim upper surface defining a rim upper plane, and wherein said platform section further includes a recessed floor located adjacent said plug aperture, a platform upper surface, and a support section extending above said platform upper surface and including a support upper surface located in said rim upper plane.

30. Apparatus of claim 28, wherein said plug aperture floor defines an air opening.

31. A resealable closure apparatus for sealing a container, said apparatus comprising:

a platform section connected to a container and including a plug aperture wall defining, a plug aperture, a plug aperture first end, and a plug aperture second end, wherein said plug aperture first end is more proximate to the geometrical center of said platform section than said plug aperture second end, and wherein said platform section further includes a plug aperture floor with a top surface, wherein said plug aperture floor extends from said plug aperture wall proximate said plug aperture first end and beneath a portion of said plug aperture, and wherein said plug aperture floor defines an air opening proximate to said plug aperture first end.

32. Apparatus of claim 31, wherein said apparatus further comprises a rim section interposed between said container and said platform section, wherein said rim section includes a rim upper surface defining a rim upper plane, and wherein said platform section further includes a recessed floor located adjacent said plug aperture, a platform upper surface, and a support section extending above said platform upper surface and including a support upper surface located in said rim upper plane.

33. Apparatus of claim 31, wherein said plug aperture first end is substantially occluded by said plug aperture floor.

34. Apparatus of claim 31, wherein said apparatus further comprises a plug so movably connected to said platform section that said plug selectively occupies said plug aperture, said plug including, a lower most bottom surface, a fulcrum end, and an opposing leading end, and wherein said top surface of said aperture floor contacts said lower most bottom surface of said plug proximate to said leading end when said plug occupies said plug aperture.

35. Apparatus of claim 1, wherein said plug includes a bottom surface, wherein platform section further includes a plug aperture wall defining said plug aperture, and a plug aperture floor extending from said aperture wall beneath said bottom surface of said plug when said plug completely occupies said plug aperture.

* * * * *